US009373897B2

(12) United States Patent
Sakita et al.

(10) Patent No.: US 9,373,897 B2
(45) Date of Patent: Jun. 21, 2016

(54) PRINTED CIRCUIT BOARD HAVING A TERMINAL WITH A FIXATION LEG AND A SOLDERING SECTION

(71) Applicant: SUMITOMO WIRING SYSTEMS, LTD., Yokkaichi, Mie (JP)

(72) Inventors: Tsuyoshi Sakita, Yokkaichi (JP); Katsuya Ito, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 14/657,616

(22) Filed: Mar. 13, 2015

(65) Prior Publication Data

US 2015/0270625 A1 Sep. 24, 2015

(30) Foreign Application Priority Data

Mar. 20, 2014 (JP) ..... 2014-058214

(51) Int. Cl.

| | |
|---|---|
| ***H01R 12/00*** | (2006.01) |
| ***H01R 4/02*** | (2006.01) |
| ***H01R 12/58*** | (2011.01) |
| *H01R 43/02* | (2006.01) |

(52) U.S. Cl.

CPC ..... *H01R 4/027* (2013.01); *H01R 12/58* (2013.01); *H01R 43/0256* (2013.01)

(58) Field of Classification Search

CPC ..... H01R 4/02; H01R 4/027; H01R 12/70; H01R 12/7082

USPC ..... 439/83

See application file for complete search history.

(56) References Cited

U.S. PATENT DOCUMENTS

| | | | | |
|---|---|---|---|---|
| 5,893,779 | A * | 4/1999 | Bianca | H01R 12/585 439/751 |
| 6,722,928 | B1 * | 4/2004 | Noda | H01R 12/585 439/751 |
| 2003/0133273 | A1 | 7/2003 | Nagaoka | |
| 2004/0175971 | A1 * | 9/2004 | Terashima | H01R 12/716 439/83 |
| 2007/0202719 | A1 * | 8/2007 | Saka | H01R 9/091 439/83 |
| 2012/0320545 | A1 * | 12/2012 | Lo Presti | H05K 1/145 361/752 |

FOREIGN PATENT DOCUMENTS

| | | |
|---|---|---|
| JP | 2003-217437 A | 7/2003 |

* cited by examiner

*Primary Examiner* — Chandrika Prasad
(74) *Attorney, Agent, or Firm* — Oliff PLC

(57) ABSTRACT

A printed circuit board with a terminal having a novel structure that enables terminals to stand on their own on the printed circuit board without using a seat, while reducing or eliminating damage to through-hole plating or an inner layer circuit. A printed circuit board with a terminal includes a terminal having soldering sections that are inserted, without being press-fitted, into through-holes of a printed circuit board and are fixed by soldering. The terminal has a fixation leg and the printed circuit board has a press-fit hole, the terminal is positioned and retained on the printed circuit board by the fixation leg of the terminal being press-fitted into the press-fit hole of the printed circuit board, and an inner circumferential surfaces of the through-holes are provided with plating, whereas an inner circumferential surface of the press-fit hole is not provided with the plating.

6 Claims, 4 Drawing Sheets

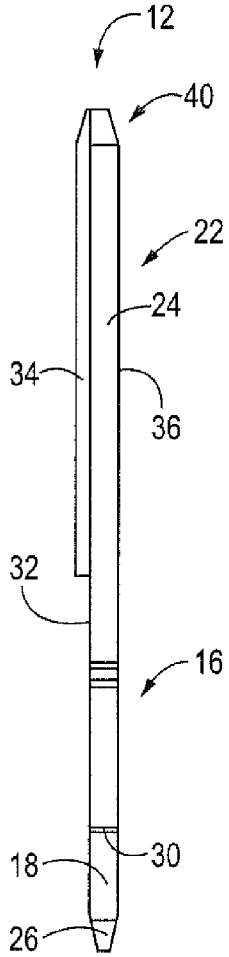
FIG. 3
FIG. 4
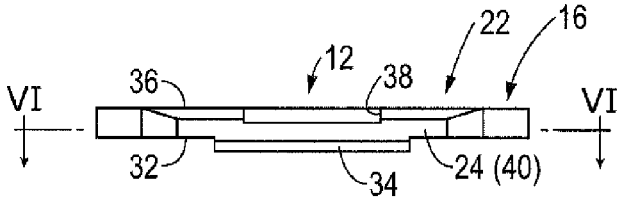
FIG. 5
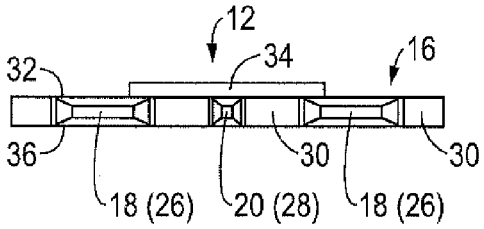

PRINTED CIRCUIT BOARD HAVING A TERMINAL WITH A FIXATION LEG AND A SOLDERING SECTION

TECHNICAL FIELD

The preferred embodiment relates to a printed circuit board with a terminal in which a soldering section of a terminal is inserted, without being press-fitted, into a through-hole of the printed circuit board, and is fixed by soldering.

BACKGROUND

Conventionally, as an internal circuit of an electrical connection box for an automobile, printed circuit boards with a terminal on which a plurality of terminals are mounted upright are widely used. On the printed circuit board with a terminal, soldering sections at one end of the terminals are arranged in the state of being inserted into through-holes of the printed circuit board with gaps therein without being in pressure contact. By having the soldering sections that are movably inserted into the through-holes being soldered to the through-holes, the soldering sections are connected to printed wires of the printed circuit board and the terminals are fixed to the printed circuit board. The other ends of the terminals, serving as connecting sections for connection to counterpart terminals, may have any shape such as a tuning fork shape or a tab shape, and are arranged projecting from the printed circuit board.

However, in such a printed circuit board with a terminal, when soldering the terminals to the printed circuit board, it is important to reliably position and retain the terminals at predetermined positions on the printed circuit board. Therefore, conventionally, as disclosed in JP 2003-217437A for example, terminals are positioned and retained on a printed circuit board in the state of being press-fitted into and retained by a seat preferably made of a synthetic resin.

However, when such a seat, which is preferably made of a synthetic resin, is used to retain the terminals, there is a problem that after soldering, the terminals and the printed circuit board are relatively displaced based on the difference in linear expansion coefficient between the printed circuit board and the seat, possibly causing solder cracking. Furthermore, there is a need for a separate component, that is, the seat, which needs to be retained using a jig at the time of soldering, and thus an increase in the number of constituent components and complication of the manufacturing processing are inevitable, causing the problem of a cost increase.

In order to solve the above-identified problem, a counter measure is proposed in which the soldering sections are press-fitted into the through-holes of the printed circuit board so that the terminals stand on their own on the printed circuit board, thereby eliminating the use of the seat. However, this counter measure has the problem that, when the soldering sections are press-fitted into the through-holes, an inner layer circuit of the printed circuit board may be damaged, causing a defect such as disconnection of wires of the inner layer circuit, or it may be difficult to ensure connection reliability due to the detachment of plating from the inner surfaces of the through-holes or a reduction in the amount of solder filling.

JP 2003-217437A is an example of related art.

SUMMARY

An object of the preferred embodiment is to solve the problem of the above-described circumferences, and it is an object of the preferred embodiment to provide a printed circuit board with a terminal having a structure that enables a terminal to stand on its own on the printed circuit board without using a seat, while reducing or eliminating damage to through-hole plating or an inner layer circuit.

A first aspect of the preferred embodiment is directed to a printed circuit board with a terminal in which a soldering section of a terminal is inserted, without being press-fitted, into a through-hole of a printed circuit board, and is fixed by soldering, wherein the terminal has a fixation leg and the printed circuit board has a press-fit hole, the terminal is positioned and retained on the printed circuit board by the fixation log of the terminal being press-fitted into the press-fit hole of the printed circuit board, and an inner circumferential surface of the through hole is plated, whereas an inner circumferential surface of the press-fit hole is not plated.

According to the printed circuit board with a terminal of the preferred embodiment, the terminal is positioned and retained on the printed circuit board by the fixation leg of the terminal being press-fitted into the press-fit hole of the printed circuit board. Therefore, when soldering the terminal on the printed circuit board, it is not necessary to retain the terminal with a seat made of a synthetic resin, making a reduction in the number of components and manufacturing processes possible. Furthermore, avoiding the use of a seat can solve the problem of solder cracking, and thus it is possible to improve the reliability of the connection between the terminal and the printed circuit board.

Furthermore, since the inner circumferential surface of the through-hole is plated and the soldering section of the terminal is inserted into the through-hole without being press-fitted, a sufficient amount of solder filling can be ensured at the time of soldering. Moreover, since the soldering section is inserted into the through-hole without being press-fitted, the plating can be prevented from becoming detached from the through-hole, making it possible to prevent damage to an inner layer circuit when it is included in the printed circuit board. Therefore, it is possible to stably ensure the reliability of the connection between the terminal and the printed circuit board.

Furthermore, since the inner circumferential surface of the press-fit hole is not plated, it is possible to set a small tolerance for the press-fit hole. Therefore, it is possible to realize highly accurate setting of the press-fit force that is needed when press-fitting the fixation leg into the press-fit hole, and the positioning and retaining force of the terminal with respect to the printed circuit board that is obtained by press-fitting the fixation leg into the press-fit hole. As a result, by managing terminal positioning and retaining properties with respect to the printed circuit board and mountability of the terminal on the printed circuit board with high accuracy to reduce the variation between products, it is possible to ensure the stability and reliability of the connection between the terminal and the printed circuit board more significantly.

A second aspect of the preferred embodiment is directed to the printed circuit board with a terminal according to the first aspect, wherein a land section may be provided on a periphery of an opening of the press-fit hole on a rear surface side of the printed circuit board from which a tip end of the fixation leg projects.

According to this aspect, a land section is provided on a periphery of an opening of the press-fit hole on a rear surface side of the printed circuit board. Accordingly, at the time of soldering, excess solder attached to the fixation leg can be caused to adsorb to the land section, and a defect that occurs due to the excess solder forming a solder ball or the like and falling off, for example, can be prevented.

A third aspect of the preferred embodiment is directed to the printed circuit board with a terminal according to the first or second aspect, wherein the terminal may have the shape of a flat plate, and has, in one end section of the terminal, the soldering section and the fixation leg projecting therefrom and, in another end of the terminal, a connecting section for connecting to a counterpart terminal, and the soldering section and the fixation leg do not project outward in the thickness direction of the terminal relative to the connecting section.

According to this aspect, since the terminal can be provided so as to stand on the printed circuit board by the fixation leg being press-fitted into and fixed to the press-fit hole, it is not necessary to bend the terminal into a crank shape and mount the bent terminal on the printed circuit board, as in the conventional case. Therefore, it is not necessary for the soldering section and the fixation leg to project outward in the thickness direction of the terminal relative to the connecting section of the terminal, and thus it is possible to greatly reduce the area for mounting the terminal on the printed circuit board. Therefore, it is possible to advantageously address the demand for downsizing and densifying a printed circuit board.

A fourth aspect of the preferred embodiment is directed to the printed circuit board with a terminal according to the third aspect, wherein in one end section of the terminal, a pair of soldering sections may respectively be provided projecting from two sides in the width direction of the terminal, and the fixation leg may be provided projecting from the central section in the width direction of the terminal.

According to this aspect, since in one end section of the terminal that has the shape of a flat plate, a pair of soldering sections are respectively provided on the two sides in the width direction, it is possible to stably fix the terminal to the printed circuit board by soldering. Moreover, since the fixation leg is provided using the space between the pair of soldering sections, spatially efficient provision of the fixation leg is possible, making it possible to address the demand for densification/space-saving of the printed circuit board.

According to the preferred embodiment, since the fixation leg of the terminal is press-fitted into the press-fit hole of the printed circuit board, the terminal is positioned and retained on the printed circuit board. Therefore, retaining the terminal using a seat at the time of soldering is no longer necessary, and it is possible to reduce the number of components and manufacturing processes. Furthermore, avoiding the use of a seat can solve the problem of solder cracking, and thus it is possible to improve the reliability of the connection between the terminal and the printed circuit board. Moreover, since the inner circumferential surface of the through-hole is plated, and the soldering section of the terminal is inserted into the through-hole without being press-fitted, it is possible not only to ensure a sufficient amount of solder filling at the time of soldering but also to prevent detachment of the plating from the through-hole and damage to the inner layer circuit of the printed circuit board. Additionally, since the inner circumferential surface of the press-fit hole is not plated, it is possible to set a small tolerance of the press-fit hole. Therefore, it is possible to realize highly accurate setting of the press-fit force that is needed when press-fitting the fixation leg into the press-fit hole, and the positioning and retaining force of the terminal with respect to the printed circuit board that is obtained by press-fitting the fixation leg into the press-fit hole.

BRIEF DESCRIPTION OF THE DRAWINGS

FIG. 3 is a side view showing the terminal of FIG. 1;

FIG. 4 is an enlarged plan view showing the terminal of FIG. 1;

FIG. 5 is an enlarged bottom view showing the terminal of FIG. 1;

EMBODIMENTS OF THE INVENTION

Figure 1:
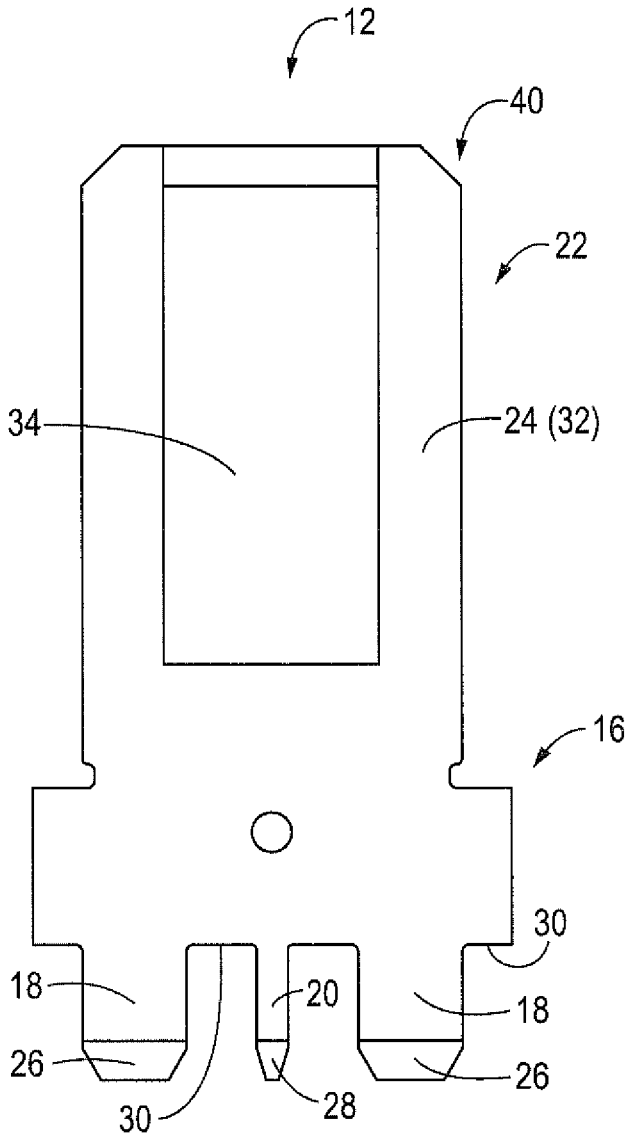
FIG. 1 is a front view showing a terminal that is included in a printed circuit board with a terminal according to a preferred embodiment.
Figure 2:
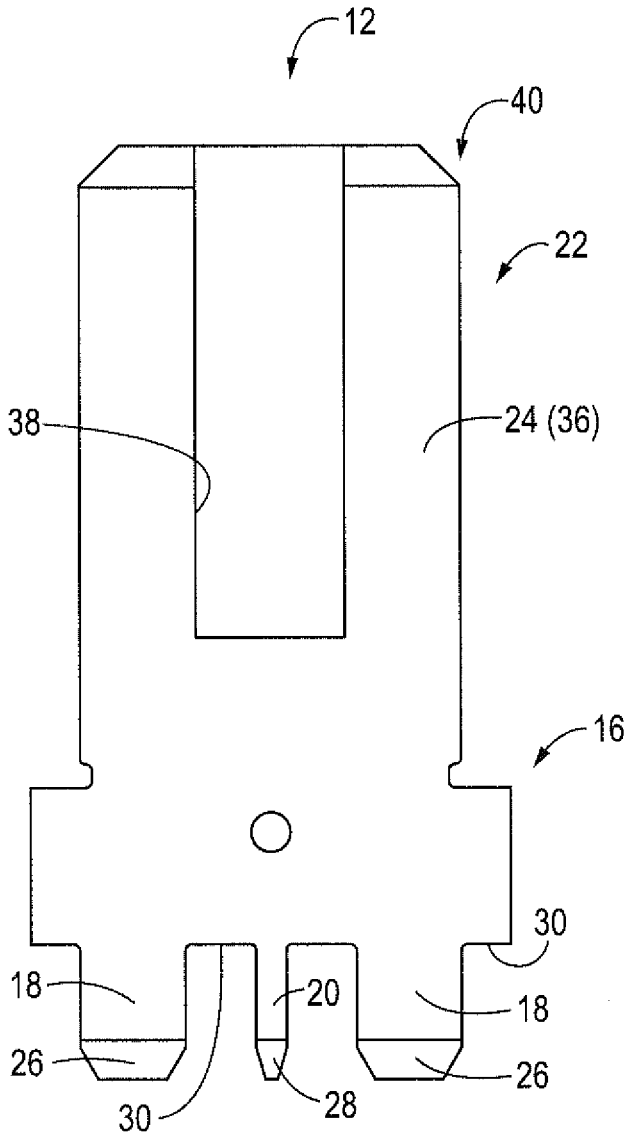
FIG. 2 is a rear view showing the terminal of FIG. 1.

Hereinafter, the embodiments will be described with reference to the drawings.

FIGS. 1 to 7 show a printed circuit board with a terminal 10 according to the preferred embodiment. The printed circuit board with a terminal 10 has the structure in which a terminal 12 is provided so as to stand on a printed circuit board 14. Note that in the following description, the width direction and the vertical direction refer to the vertical direction in FIG. 1, and the width direction refers to the horizontal direction in FIG. 1. Note also that the thickness direction refers to the direction that is perpendicular to the plane of the drawing surface of FIG. 1.

The terminal 12 has the shape of a flat plate, and is formed by being press-cut from a metal plate such as, for example, a copper plate whose surface is plated with tin or the like. In one end section 16 in the length direction of the terminal 12, a pair of soldering sections 18 and a fixation leg 20 are formed, whereas in an other end 22 in the length direction of the terminal 12, a connecting section 24 for connecting to a counterpart terminal (not shown) is formed.

The one end section 16 in the length direction of the terminal 12 has the shape of a horizontally-long and substantially rectangular flat plate, and includes, in the two side sections in the width direction thereof, the pair of soldering sections 18 that have the shape of a wide flat plate and project outward in the length direction (downward in FIG. 1). The pair of soldering sections 18 have tip end edges on which tapered tip sections 26 are respectively formed, as in a conventionally used terminal. On the other hand, in the central section in the width direction of the one end section 16, the fixation leg 20 is provided as well and has the shape of a narrow flat plate and projects outward in the length direction. Similar to the pair of soldering sections 18, the fixation leg 20 also has a tip end edge on which a tapered tip section 28 is formed. That is, both the pair of soldering sections 18 and the fixation leg 20 are formed projecting outward in the length direction of the terminal 12, but not outward in the thickness direction (the direction perpendicular to the drawing surface of FIG. 1). Note that since the one end section 16 is wider than the other end 22, an abutting section 30 that abuts against the printed circuit board 14 can have a large area, and thus it is possible to stably mount the terminal 12 on the printed circuit board 14.

On the other hand, the connecting section 24 has the shape of a vertically-long and substantially rectangular flat plate, and includes an engagement protrusion 34 on one surface 32 of the connecting section 24, and an engagement recess 38 on an other surface 36 that is opposite to the one surface 32. The engagement protrusion 34 is formed projecting outward in the thickness direction (downward in FIG. 4) with a substantially constant height in a substantially rectangular manner, and is provided in the central section in the width direction of the one surface 32 extending over the majority of the length direction from the tip end side (upper end side in FIG. 1). On the other hand, the engagement recess 38 is formed with a substantially constant depth, and has a narrower width than the engagement protrusion 34 provided at a position opposite to the engagement recess 38. Note that similarly to the soldering sections 18 and the fixation leg 20, the connecting section 24 also has a tip end edge on which a tapered tip section 40 is formed. An engagement recess and an engagement protrusion of a counterpart terminal (not shown) are engaged with the engagement protrusion 34 and the engagement recess 38 so that the connecting section 24 and the counterpart terminal are reliably retained in the state of being engaged.

Figure 6:
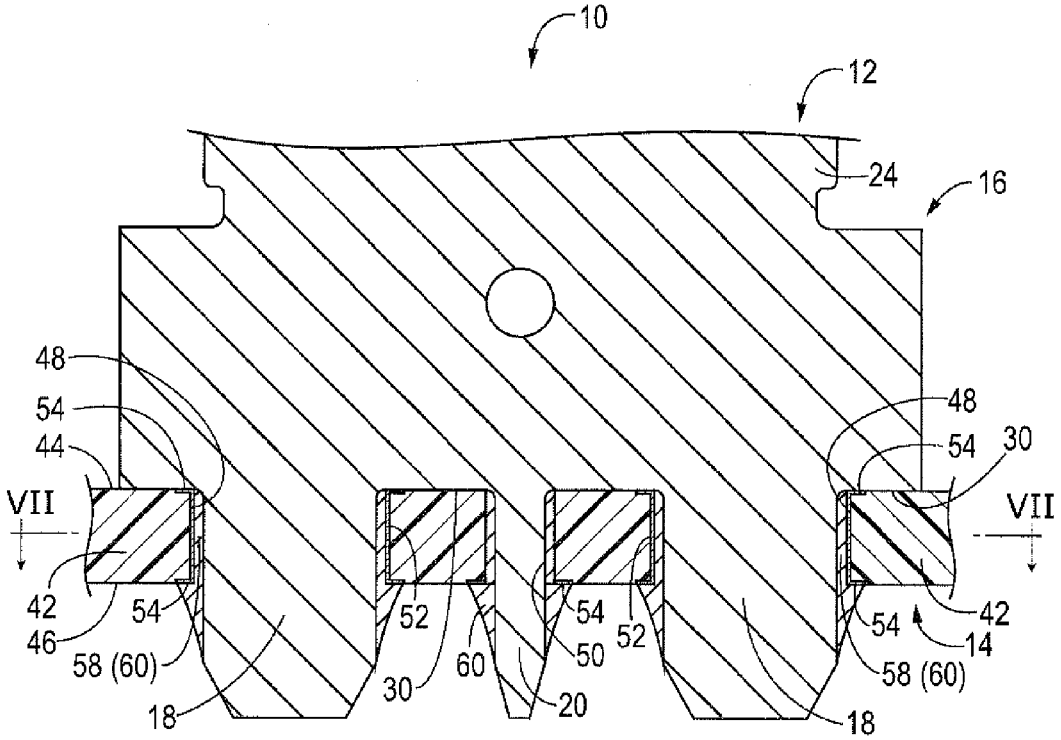
FIG. 6 is a cross-sectional view taken along the line VI-VI of FIG. 4, showing the state in which the terminal is provided so as to stand on the printed circuit board (that is, a cross-sectional view of the printed circuit board with a terminal according to one embodiment of the present invention)

As shown in FIG. 6, the printed circuit board 14 is a printed circuit board in which printed wires (not shown) are provided on a front surface 44 and a rear surface 46 of an insulated substrate 42 that has the shape of a substantially rectangular flat plate and is made of a well-known insulating material, such as a glass epoxy resin. Furthermore, as shown in FIGS. 5 and 6, the printed circuit board 14 has a pair of through-holes 48 through which the pair of soldering sections 18 of the terminal 12 are to be inserted, and a press-fit hole 50 through which the fixation leg 20 of the terminal 12 is to be inserted.

Figure 7:
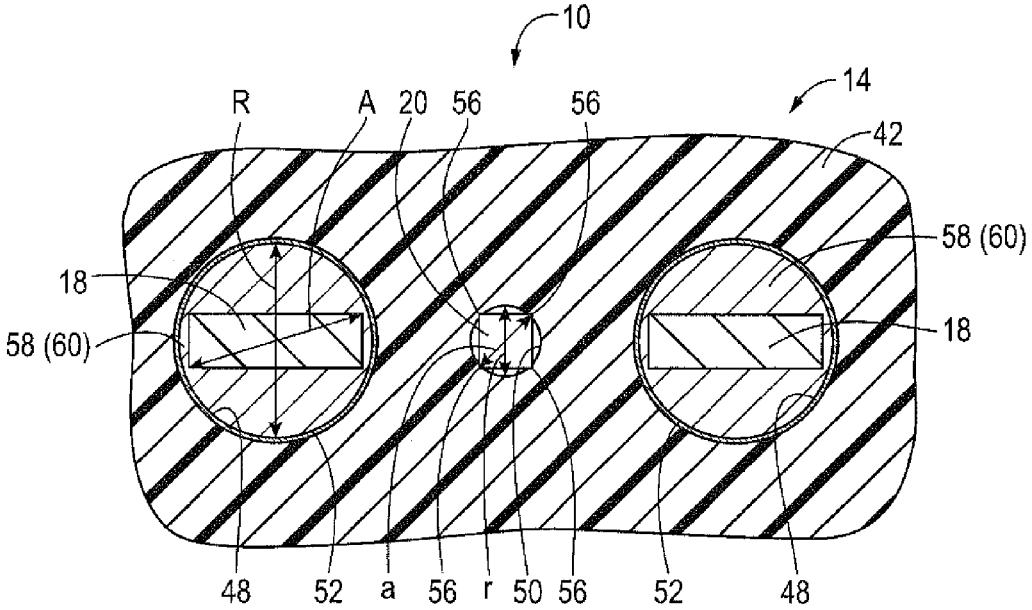
FIG. 7 is a cross-sectional view taken along the line VII-VII of FIG. 6.

As shown in FIGS. 6 and 7, each through-hole 48 is a through-hole that has a substantially circular cross-section, and has a diameter R that is larger than a diagonal size A of the rectangular cross-section of the soldering section 18 of the terminal 12 (R>A). Furthermore, plating 52 is provided over the entire inner circumferential surface of the through-hole 48, and land sections 54 are provided on the periphery of the opening of the through-hole 48 on the front surface 44 and the rear surface 46 sides of the printed circuit board 14. On the other hand, the press-fit hole 50 is a through-hole that has a substantially circular cross-section, and has a diameter r that is smaller than a diagonal size a of the rectangular cross-section of the fixation leg 20 of the terminal 12 (r<a). Furthermore, although the inner circumferential surface of the press-fit hole 50 is not provided with plating 52, a land section 54 is provided on the periphery of the opening of the press-fit hole 50 on the rear surface 46 side of the printed circuit board 14 from which the tip end of the fixation leg 20 projects.

Furthermore, as shown in FIGS. 6 and 7, the pair of soldering sections 18 and the fixation leg 20 of the terminal 12 are respectively inserted into the pair of through-holes 48 and the press-fit hole 50 of the printed circuit board 14 that has the above-described structure, from the front surface 44 side of the printed circuit board 14 to the rear surface 46 side. The amount of insertion of the one end section 16 of the terminal 12 into the through-holes 48 and the press-fit hole 50 is defined by the abutting section 30 abutting against the front surface 44 of the printed circuit board 14, and the one end section 16 is positioned and retained in the state in which the tip end thereof protrudes from the through-holes 48 and the press-fit hole 50 on the rear surface 46 of the printed circuit board 14. At that time, since the diameter r of the press-fit hole 50 is smaller than the diagonal size a of the rectangular cross-section of the fixation leg 20, the fixation leg 20 is press-fitted into the press-fit hole 50 in the state in which four corner sections 56 of the fixation leg 20 are pressed against the inner circumferential surface of the press-fit hole 50. As a result, the terminal 12 stands on the printed circuit board 14 while being positioned and retained. On the other hand, since the diameter R of each through-hole 48 is larger than the diagonal size A of the rectangular cross-section of the soldering section 18, the soldering section 18 is arranged in the state of being inserted into the through-hole 48 with a gap 58 therein without being in pressure contact. Furthermore, by the gaps 58 being filled with solder 60 by soldering, the terminal 12 and the printed wires of the printed circuit board 14 are conductively connected to each other via the solder 60 and the plating 52 and the soldering sections 18 are fixed to the through-holes 48, and thus the printed circuit board with a terminal 10 is formed.

According to the printed circuit board with a terminal 10 having such a structure, since the diameter r of the press-fit hole 50 is smaller than the diagonal size a of the rectangular cross-section of the fixation leg 20, the fixation leg 20 is press-fitted into the press-fit hole 50 in the state in which the four corner sections 56 of the fixation leg 20 are pressed against the inner circumferential surface of the press-fit hole 50. As a result, the terminal 12 is positioned and retained on the printed circuit board 14. Therefore, a synthetic resin seat that is conventionally needed when a terminal is soldered to the printed circuit board is no longer necessary. With this, it is possible to reduce the number of constituent components and manufacturing processes, and to solve the problem of solder cracking that occurs due to the seat.

Furthermore, since each soldering section 18 is arranged in the state of being inserted into the through-hole 48 with the gap 58 therein without being in pressure contact, and the inner circumferential surface of through-hole 48 is provided with the plating 52, it is possible to ensure a sufficient amount of solder filling at the time of soldering. Furthermore, since the soldering section 18 is not in pressure contact with the through-hole 48, it is possible to efficiently prevent the plating 52 from becoming detached from the through-hole 48. Furthermore, even in the case where printed wires are provided in an inner layer of the printed circuit board 14, it is also possible to prevent measling from occurring due to damage to the printed wires in the inner layer.

Moreover, since the inner circumferential surface of the press-fit hole 50 is not provided with the plating 52, it is possible to reduce the amount of variation (dimension tolerance) in the diameter r of the press-fit hole 50. Since the press-fit hole 50 can be formed with a small and accurate diameter r, it is possible to realize downsizing of the printed circuit board with a terminal 10, and to realize ensuring the connection stability and reliability through the reduction in the variation.

Furthermore, since in the vicinity of the tip section of the fixation leg 20 that projects from the rear surface 46 of the printed circuit board 14, the land section 54 is provided on the periphery of the opening of the press-fit hole 50 on the rear surface 46 side, excess solder 60 attached to the fixation leg 20 can be adsorbed between the fixation leg 20 and the land section 54. As a result, it is possible to prevent, for example, the defect that occurs due to the excess solder forming a solder ball or the like and falling off.

In addition, since it is possible to stand the terminal 12 on the printed circuit board 14 by press-fitting and fixing the fixation leg 20 into the press-fit hole 50, the terminal does not need to be bent into a crank shape as in the conventional case. Therefore, it is possible to downsize the terminal 12, and to significantly reduce the area for mounting the terminal 12 on the printed circuit board 14, making it possible to advantageously address the demand for downsizing and densifying the printed circuit board 14. Furthermore, since the terminal 12 has the pair of soldering sections 18, it is possible to stably fix the terminal 12 to the printed circuit board 14. Moreover, since the fixation leg 20 is provided using the space in the intermediate section between the pair of soldering sections 18, spatially efficient provision of the fixation leg 20 is possible.

Although the above-described embodiments have been described in detail, additional embodiments are not limited to these specific descriptions. For example, an embodiment has been described in which the soldering sections 18 and the fixation leg 20 that have rectangular cross-sections, but additional embodiments are of course not limited to this shape, and the soldering sections 18 and the fixation leg 20 that have the cross-sectional shape of a circle, an ellipse, a polygon, or the like may also be selected. Furthermore, the through-hole 48 and the press-fit hole 50 may be, for example, a circular, ellipsoidal, or polygonal cross-sectional shape. In addition, the printed wires may also be provided in the inner layer of the printed circuit board 14. Note that in the above-described embodiments, two soldering sections 18 are provided, but one, or three or more soldering sections 18 may be provided. Furthermore, one fixation leg 20 is provided, but a plurality of fixation legs 20 may also be provided.

LIST OF REFERENCE NUMERALS

10 Printed circuit board with, a terminal
12 Terminal
14 Printed circuit board
16 One end section
18 Soldering section
20 Fixation leg
22 Other end
24 Connecting section
46 Rear surface
48 Through-hole
50 Press-fit hole
52 Plating
54 Land section

What is claimed is:

1. A printed circuit board comprising:

a terminal having a fixation leg;

a press-fit hole; and a soldering section of the terminal, the soldering section being inserted into a through-hole of the printed circuit board, and fixed to the printed circuit board by soldering, wherein the terminal is positioned and retained on the printed circuit board by the fixation leg of the terminal and is press-fitted into the press-fit hole of the printed circuit board, and an inner circumferential surface of the through-hole is plated, and an inner circumferential surface of the press-fit hole is not plated.

2. The printed circuit board according to claim 1, wherein a land section is provided on a periphery of an opening of the press-fit hole on a rear surface side of the printed circuit board from which a tip end of the fixation leg projects.

3. The printed circuit board according to claim 1, wherein the terminal has the shape of a flat plate, and has a first end section and a second end section, the first end section having the soldering section and the fixation leg projecting therefrom, and the second end section having a connecting section for connecting to a counterpart terminal, and the soldering section and the fixation leg do not project outward in the thickness direction of the terminal relative to the connecting section.

4. The printed circuit board according to claim 3, wherein in the first end section of the terminal, a pair of soldering sections project from two sides in the width direction of the terminal, and the fixation leg projects from a central section in the width direction of the terminal.

5. The printed, circuit board according to claim 2, wherein the terminal has the shape of a flat plate, the terminal having a first end section, the first end section having the soldering section and the fixation leg projecting therefrom, and the terminal having a second end section, the second end section having a connecting section for connecting to a counterpart terminal.

6. The printed circuit board according to claim 5, wherein in the first end section of the terminal, a pair of soldering sections project from two sides in the width direction of the terminal, and the fixation leg projects from a central section in the width direction of the terminal.

* * * * *